US006346923B1

(12) United States Patent
Johnson

(10) Patent No.: US 6,346,923 B1
(45) Date of Patent: Feb. 12, 2002

(54) LOCALIZER ANTENNA SYSTEM

(75) Inventor: John Henry Johnson, Leesburg, VA (US)

(73) Assignee: Watts Antenna CO, Herndon, VA (US)

( * ) Notice: Subject to any disclaimer, the term of this patent is extended or adjusted under 35 U.S.C. 154(b) by 0 days.

(21) Appl. No.: 09/233,747

(22) Filed: Jan. 20, 1999

(51) Int. Cl.[7] ..... H01Q 3/04
(52) U.S. Cl. ..... 343/853
(58) Field of Search ..... 343/853, 905, 343/769; H01Q 13/10, 3/04

(56) References Cited

U.S. PATENT DOCUMENTS 4,358,764 A * 11/1982 Cheal et al. ..... 343/853
4,833,482 A * 5/1989 Trinh et al. ..... 343/853
5,039,995 A * 8/1991 Hlbert ..... 343/853

* cited by examiner

*Primary Examiner*—Michael C. Wimer

(57) ABSTRACT

This invention relates to improvements in runway localizer antennas for the Instrument Landing System (ILS). The environment of modern airports has required that localizer antenna systems have larger apertures, with more elements, in order to produce the narrow beams needed to reduce multi-path interference. This, in turn, causes increases in the cost and complexity of the DU and associated coaxial feed cables. This invention uses features of a slotted cable antenna to replace a central distribution unit with a low-loss rigid copper transmission line running the entire length of the array. The radiating elements are fed from short cables through adjustable capacitors connected periodically along the rigid line.

2 Claims, 1 Drawing Sheet

LOCALIZER ANTENNA SYSTEM

CROSS-REFERENCE TO RELATED APPLICATIONS

"Not applicable"

STATEMENT REGARDING FEDERALLY SPONSORED RESEARCH OR DEVELOPMENT

"Not applicable"

REFERENCE TO A MICROFICHE APPENDIX

"Not applicable"

BACKGROUND OF THE INVENTION

This invention relates to improvements in runway localizer antennas for the Instrument Landing System (ILS). Many localizer antenna systems employ an array of radiating elements, fed by coaxial cables from a centrally located distribution unit, (DU). The environment of modern airports has required that localizer antenna systems have larger apertures, with more elements, in order to produce the narrow beams needed to reduce multi-path interference. This, in turn, causes increases in the cost and complexity of the DU and associated coaxial feed cables. This invention uses features of an earlier U.S. Pat. No. 3,577,197, May 4, 1971, Watts, Jr., "Slotted Cable Localizer Antenna," (Ref.1) to replace the central DU with a low-loss rigid copper transmission line running the entire length of the array. The radiating elements are fed from short cables through adjustable capacitors connected periodically along the rigid line. The result is a structure of reduced cost and complexity.

BRIEF SUMMARY OF THE INVENTION

This antenna system radiates simultaneous sum and difference patterns carrying standard ILS reference (CSB) and deflection (SBO) components of the transmitted signal. The signal components from an ILS transmitter are supplied through an rf bridge (hybrid) to both ends of a distributor structure. Optional isolators inserted in the coaxial feed lines improve the impedance presented to the transmitter. An object of the invention is to provide a localizer antenna system having improved efficiency and ease of construction. This is accomplished through the particular arrangement of parts, including a rigid copper coaxial transmission line running the entire length of the array, with capacitive taps feeding the individual elements.

DETAILED DESCRIPTION OF THE INVENTION

Figure 1:
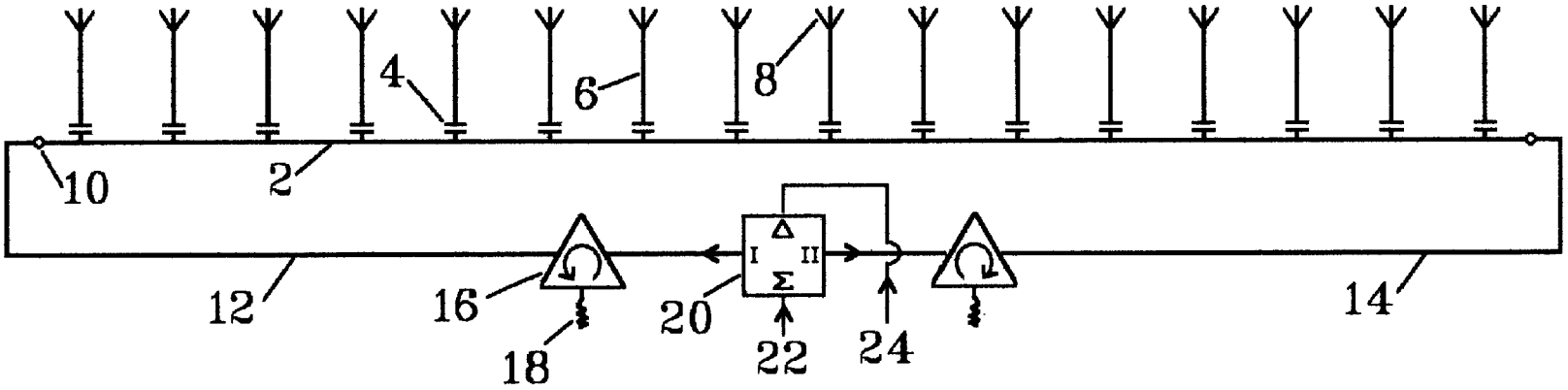
FIG. 1 is an schematic diagram of an embodiment of the localizer antenna system, including feed circuitry.

In an overall view, FIG. 1, of the improved localizer antenna system, line 2 represents the inner conductor of a low-loss rigid copper transmission line running the entire length of the array. Periodically along the length, coupling capacitors 4 connect to line 2. Capacitors 4 may be adjusted individually to control the amplitude of signal transferred into feed cables 6. Typically, the size of capacitors 4 becomes progressively smaller, symmetrically, toward the ends of the array, producing the element current amplitude taper required for low side lobes. The length of the feed cables 6 may be adjusted individually to control the phase of signal transferred into antenna elements 8. The line 2 has a coaxial connector 10 at each end to receive signal from the main left feed cable 12 and the main right feed cable 14. Optional isolators 16 are provided to improve the cable impedance, diverting reflected power into resistive loads 18. The antenna system is fed from a standard localizer transmitter through (bridge) hybrid 20 supplying, simultaneously, even and odd (sum and difference) rf current distributions, as described more fully in Ref.1. Sun mode signal is supplied at terminal 22, while difference mode signal is supplied at terminal 24.

I claim:

1. An antenna system comprising a coaxial transmission line, or wave-guide, a multiplicity of coupling devices, connected to said line of wave-guide, spaced, along the length of said line or wave-guide, at a constant interval, said constant interval being equal to half the guide wavelength, or integral multiple thereof, plus or minus a given length increment, said increment being less than the guide wavelength divided by the total number of said devices in use, said use being to couple energy to a multiplicity of elements capable of radiation.

2. An antenna system as in claim 1, wherein a hybrid is connected to both ends of said transmission line or wave-guide, said hybrid having two input terminals, each input terminal being connected to a separate source of radio frequency energy, thereby providing radiation simultaneously, in a relatively narrow azimuth sector, of both odd and even mode antenna patterns.

* * * * *